United States Patent [19]

Friedman et al.

[11] Patent Number: 4,583,023

[45] Date of Patent: Apr. 15, 1986

[54] ELECTRON BEAM HEATED THERMIONIC CATHODE

[75] Inventors: Herbert W. Friedman, Marblehead; Dennis A. Reilly, Hamilton, both of Mass.

[73] Assignee: Avco Everett Research Laboratory, Inc., Everett, Mass.

[21] Appl. No.: 633,602

[22] Filed: Jul. 23, 1984

[51] Int. Cl.[4] ..... H01J 11/04

[52] U.S. Cl. ..... 313/346 R; 313/37; 313/310; 313/340; 313/352; 315/32

[58] Field of Search ..... 315/32; 313/37, 310, 313/340, 352, 346 R, 346 DC

[56] References Cited

U.S. PATENT DOCUMENTS 3,958,146 5/1976 Buescher et al. ..... 313/346 R

*Primary Examiner*—Harold Dixon

*Attorney, Agent, or Firm*—Melvin E. Frederick

[57] ABSTRACT

A preferably fully impregnated dispenser cathode member or the like forming part of an electron tube, electron beam generator or the like is initially heated by any suitable means to a temperature sufficient for low level electron emission from its rear surface. A hot plate member of preferably equal size is disposed behind the cathode and can either be part of or the means for initially heating the cathode member or it can be heated with the cathode member to the aforementioned cathode member's rear surface low level emission temperature. A sustainer voltage is applied between the cathode member and the hot plate member sufficient to draw a current comprising electron flow from the cathode member to the hot plate member across the space separating them. This current flow or back electron beam results in heating of the hot plate member to a temperature sufficient to raise the closely spaced cathode member to, and then maintain it at, the desired emission temperature and simultaneously allow timely termination of the initial heating process since it is needed only initially.

14 Claims, 7 Drawing Figures

ELECTRON BEAM HEATED THERMIONIC CATHODE

BACKGROUND OF THE INVENTION

This invention relates to electron devices comprising a thermionic cathode and, more particularly, to devices using broad area thermionic cathodes for producing large area electron beams.

Large area electron beams are used in many applications including, for example, curing of paints and the like, as well as in various types of lasers. Thermionic cathodes have emerged as the leading candidate for the electron emission source of large area electron beams for use especially in high power lasers and the engineering concept, and design of the heater structure for such thermionic cathodes is of prime importance for their successful implementation. Present heater structure designs are expensive and difficult to scale to large area. Thus, for example, high peak temperatures in ceramic insulator components reduce system lifetime and thermal runaway conditions result in low reliability. Such present thermionic cathodes are inefficient, expensive, complex, have low reliability and cannot operate at high temperatures for long periods of time.

Thermionic cathodes in accordance with the present invention will operate reliably at high temperatures for long periods of time and are of simple design and inexpensive to produce. This is accomplished by the provision in an evacuated enclosure of a fully impregnated dispenser cathode member or the like which is initially heated by any suitable means to a temperature sufficient for low level electron emission from its rear surface. A heating body or hot plate member of preferably equal size is disposed behind the cathode and can either be part of or the means for initially heating the cathode member or it can be heated with the cathode member to the aforementioned cathode member's rear surface temperature corresponding to a low emission level.

A voltage is applied between the cathode and hot plate member sufficient to draw a current comprising electron flow from the cathode member to the hot plate member across the space separating them. This current flow or back electron beam results in heating of the hot plate member to a temperature sufficient to raise the closely spaced cathode member to, and then maintain it at, the desired front surface emission temperature and simultaneously allow timely termination of the initial heating process since it is only needed initially.

In its general aspect, the present invention has the objective of overcoming the aforementioned disadvantages of prior art directly and indirectly heated thermionic cathodes.

It is another object to provide large area thermionic cathodes.

It is another object to provide a large area thermionic cathode having a new and novel heating arrangement substantially insensitive to thermal runaway conditions.

A further object is to provide a large area thermionic cathode having uniform electron emission that operates reliably and efficiently at high temperatures for long periods of time.

The novel features that are considered characteristic of the invention are set forth in the appended claims; the invention itself, however, both as to its organization and method of operation, together with additional objects and advantages thereof, will best be understood from the following description of a specific embodiment when read in conjunction with the accompanying drawings, in which:

While the present invention will be described in connection with planar cathodes for convenience and simplicity, it is to be understood that it is not limited to planar configurations and/or the production of large area electron beams. Cathodes in accordance with the invention may take other shapes, such as curved or cylindrical shapes, for example, and have small areas.

In other cases the cathode can be cup-shaped, cylindrical and the like as circumstances may require.

Figure 1:
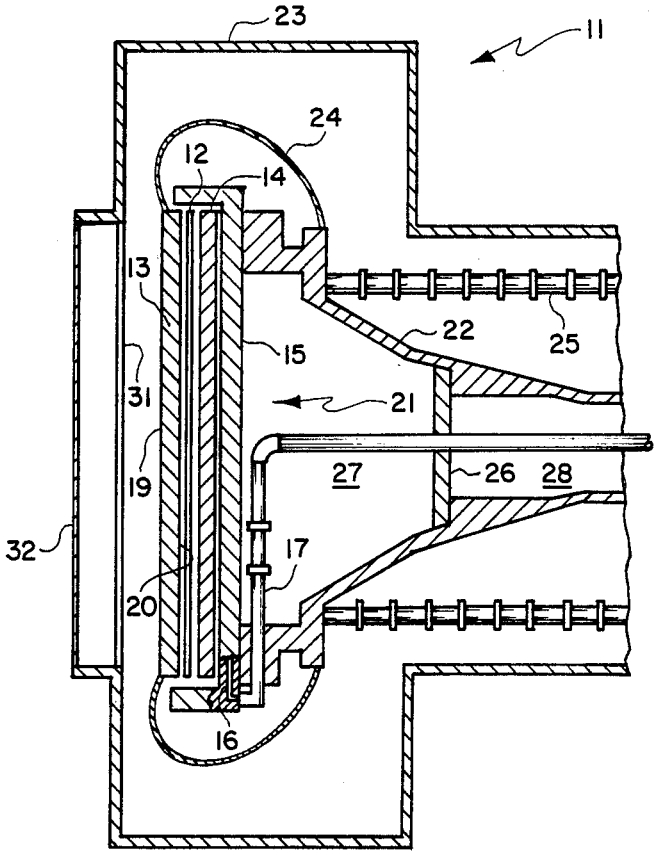
FIG. 1 is a sectional side view of a broad area electron beam generator in accordance with one embodiment of the invention.
Figure 2:
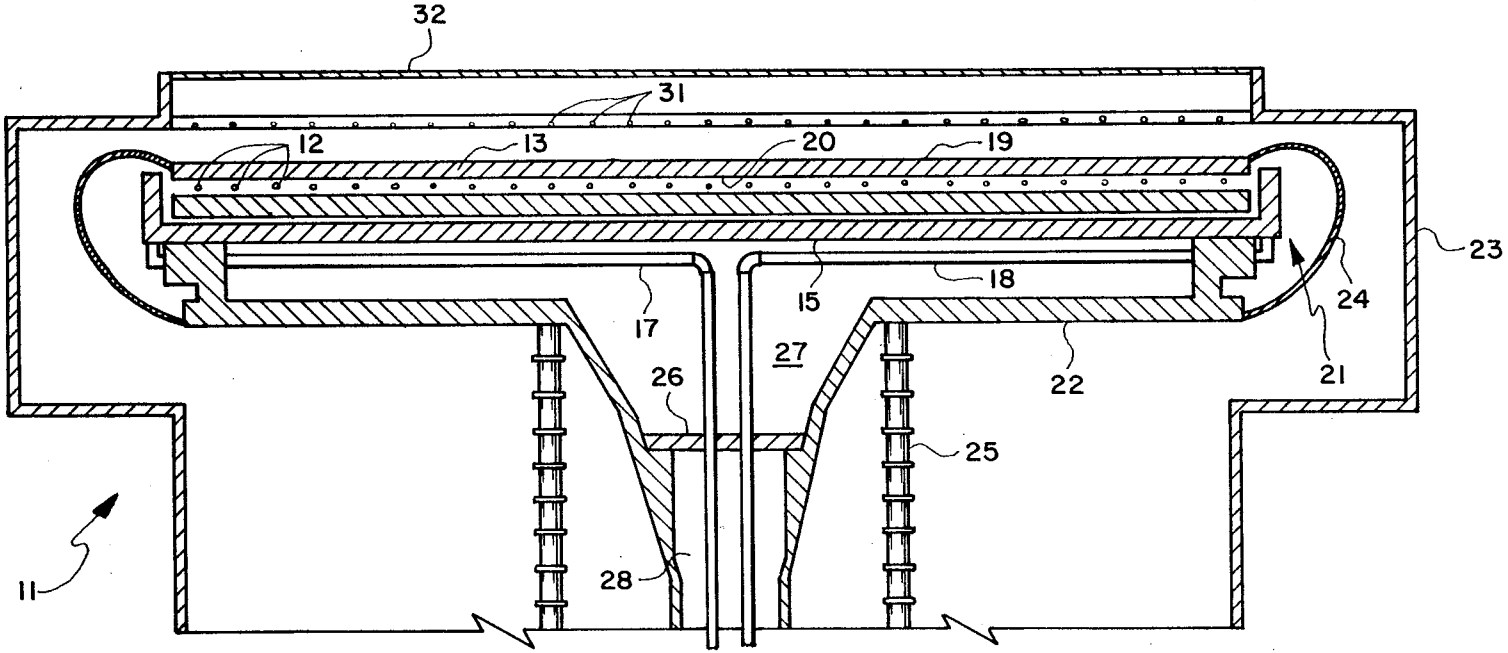
FIG. 2 is a top sectional view of the generator of FIG. 1.

For the embodiment shown in FIGS. 1 and 2, in the evacuated portion of an electron beam generator, designated generally by the numeral 11, uniformly spaced electrical heater filaments 12 are disposed behind and spaced from a cathode 13 or electron emissive body such as, for example, a conventional fully impregnated planar barium dispenser cathode. The heater filaments 12 are selectably connected to a suitable starter power supply for supplying heater current more fully described in connection with FIG. 3. Disposed rearwardly and spaced from the heater filaments 12 is a refractory high temperature heating body or hot plate member 14 having the same configuration as the cathode 13. The heating body 14 may, for example, be in the form of a tungsten, tantalum or molybdenum block or a suitable material capable of withstanding high temperatures in the range of 1000° C. to 2000° C. and conducting the current from the back election beam.

To keep heating losses at a minimum, a cup-shaped radiation shielding member 15 is disposed behind the heating body 14 and functions to keep rearward and peripheral heating losses from the cathode 13, filaments 12 and heating body 14 at a minimum. Where required, shielding members may be provided with coolant passages 16 connected to inlet and outlet coolant pipes 17 and 18 more fully described hereinafter. The cathode structure 21, herein defined as comprising the cathode 13, filament heaters 12, heating body 14 and shielding member 15 are all suitably supported and insulated in conventional manner as by ceramic spacers and insulators (not shown) in an inner housing member 22 extending rearwardly through the rear of an outer housing member 23 and having smoothly curved peripheral portions 24 to reduce the possibility of arcing. The inner housing member 22 is supported by a conventional high voltage bushing 25 having an interior sealing wall 26. The portion 27 of the inner housing 22 forward of the sealing wall 26 and surrounding the cathode structure 21 comprises part of the evacuated portion of the electron beam generator 11. The portion of the inner housing rearward of the sealing wall 26 may, for example, be filled with oil for electrical insulation purposes since an accelerating voltage of typically 100 KV or more is applied between the cathode 13 and an accelerating grid 31. The outer housing 23, electron window 32 and accelerating grid 32 are typically at ground potential and thus, since the inner housing 22 and cathode 13 are in conventional manner at a high potential with respect to ground, high voltage bushing 25 and associated high voltage insulation is required.

Figure 3:
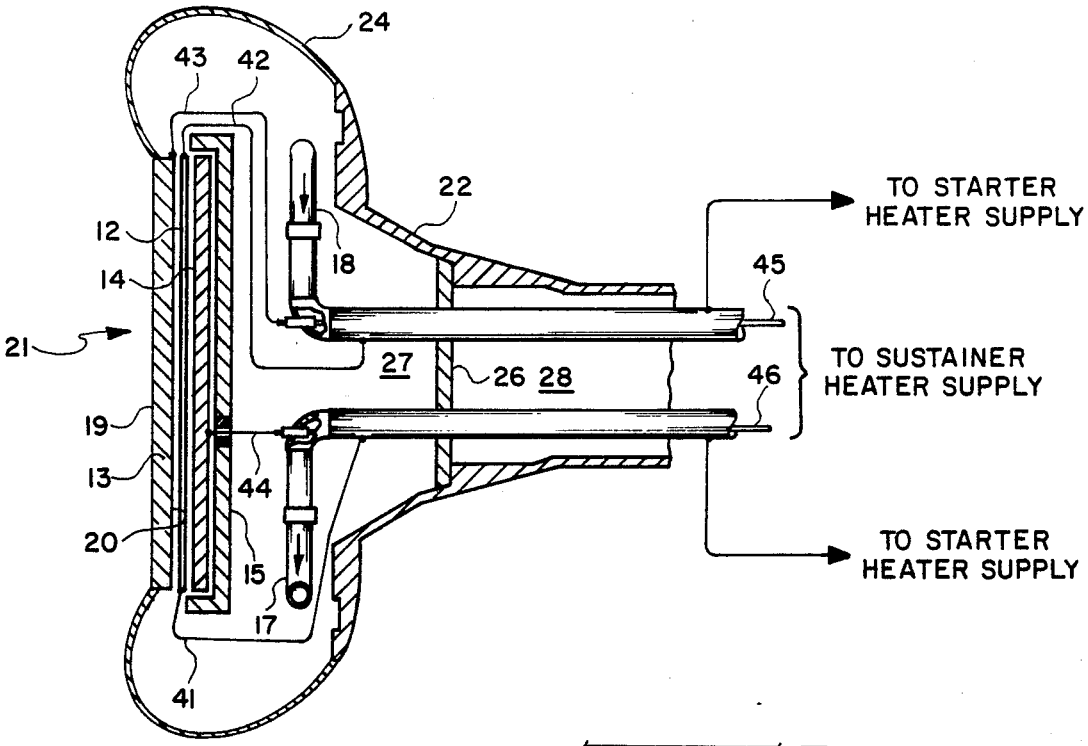
FIG. 3 is a sectional side view showing additional details of the thermionic cathode structure shown in FIG. 1.

Directing attention now to FIG. 3, there is illustrated an arrangement for connecting the cathode 13, heater filaments 12 and heating body 14 to the heater power supplies. Thus, the heater filaments 12 are connected to a starter heater power supply (not shown) via inlet water pipe 17, conductor 41, conductor 42 and outlet water pipe 18. Cathode 13 and heating body 14 are connected across a sustainer heater power supply (not shown) via conductors 43 and 44 which, in turn, are connected to conductors 45 and 46 which are disposed within and insulated from the inlet and outlet water pipes 17 and 18.

For the embodiment of FIGS. 1 and 2, shown merely by way of illustration, assume that the interior of outer housing 23 has been evacuated to a suitable low pressure and that the cathode 13 is a fully impregnated barium dispenser cathode or a cathode block impregnated on both sides and the heating body 14 is a tungsten block. The starter heater power supply is connected to the heater filaments to raise the temperature of the cathode to a temperature above its electron emission temperature for a low level emission from its back side 20. The presence at this time of a suitable voltage between the cathode and heating body from the sustainer heater power supply will cause a current or back electron beam to be drawn from the back side 20 of the cathode to the heating body. This back electron beam current flow will now cause heating of the heating body which, in turn, will radiationally heat the cathode in a "boot strap" manner. Adjustment of the back electron beam power by adjusting the sustainer voltage sufficient to overcome all radiational and conduction losses permits the temperature of the cathode to be simply and efficiently raised to and then maintained at substantially any desired operating temperature. When the back electron beam current begins to flow, the heater filaments are no longer needed and, therefore, may be disconnected from their power source.

Since both the starter heater power supply system for initially bringing the cathode up to a temperature sufficient for low level emission and the sustainer heater power supply system for taking over when emission begins, must be sufficient to overcome all radiational and conduction losses, the use of radiational shields and the like is indicated. Further, since the surface area/perimeter area ratio gets larger and the ratio of cathode size to cathode-heating body spacing get smaller for large size cathodes, edge losses for such sizes as a percentage of total losses gets smaller. In addition, once the front surface 19 of the cathode has been brought up to its desired operating temperature to provide the desired electron beam current density from the front surface 19 of the cathode, there is no macroscopic instability. Typically and merely by way of example, a suitable starter heater power supply, in one instance using resistance heating, provided about 0.33 amperes per square centimeter of cathode area at about 30 volts, and the sustainer heater power supply provided about 10 milliamps at about 1000 volts.

Typical radiation losses for a tungsten surface at about 1200° C. are in the range of about 10 watts/sq. cm. Thus, the sustainer heater power need only make up such losses and to do so for such a case, the product of current density of the back electron beam and voltage should correspond to about 10 watts/sq. centimeter of cathode area to maintain a constant temperature.

If the heating body is, inter alia, spaced from the cathode the distance necessary to draw a space charge limited back electron beam current of the desired and generally low level emission density, thermal runaway conditions cannot exist, since heating in excess of design limitations is automatically prevented because the back electron beam current is space charge limited. Hence the sustainer heater concept is inherently stable.

The space charge limited back electron beam characteristic of the present invention may also be utilized to compensate for edge losses. Thus, if the spacing between the cathode and heating body at their peripheries is reduced and the space charge limit thereby incurred, such spacing may be selected to provide increased heating at the peripheries by an amount to just compensate for edge losses and thereby result in more uniform heating of the cathode.

Electron beam generators in accordance with the invention are macroscopically stable because at typical front surface electron beam current densities, the cathode temperature is far above that required for the back electron beam emission limit. Accordingly, minor increases or decreases in voltage will only shift the equilibrium temperature to a different value. This is because variations in the voltage affects the current according to the two-thirds power and the variations in current only change the radiation of the heating body and, hence, the cathode temperature. As long as the cathode operating temperature is reasonably above the emission limit (which typically needs to be only for low level emission), no feedback mechanism exists for voltage instability. If the voltage increases substantially, back electron beam current flow is space charge limited.

However, if the voltage drops sufficiently to drop the cathode temperature below the back electron beam emission limit, the back electron beam current will decrease and the cathode-heating body pair can spiral down in temperature and extinguish, thereby providing a large amplitude instability for large voltage decreases over periods sufficient for cathode structure temperatures to decrease.

Figure 7:
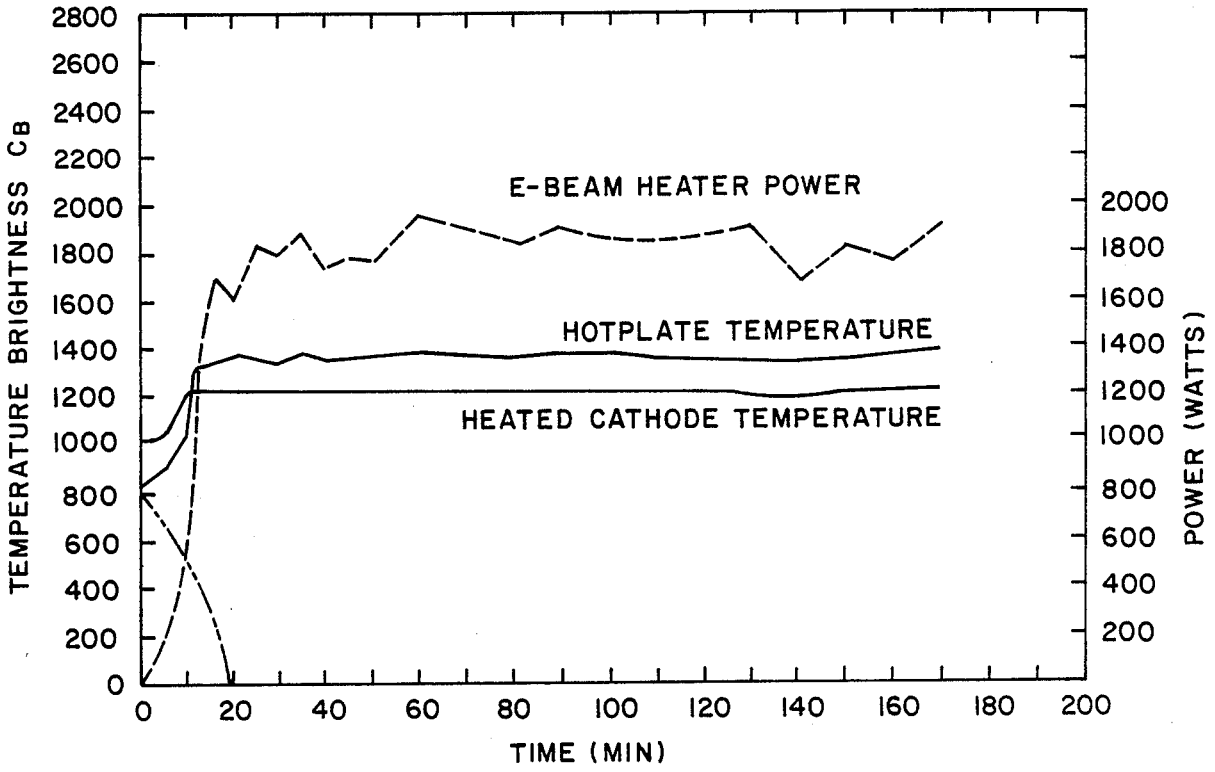
FIG. 7 is a plot of heater power and temperatures for a cathode structure arrangement in accordance with the invention.

A plot of resistance heater power, back electron beam power, cathode temperature and heating body temperature for a cathode structure arrangement in accordance with the invention is shown in FIG. 7. The system was 10 cm×10 cm with a spacing of 1.25 cm corresponding to a sustainer voltage level of approximately 700 volts. The cathode was raised to approximately 1225° $C_B$ (Brightness temperature). A warm-up time of approximately two minutes was demonstrated, starting from a cathode temperature of approximately 800° C. corresponding to a resistive input power level of approximately 500 W. A low power of only about 1.8 KW was needed to maintain the cavity at 1225° $C_B$.

Stable hands-off operation was achieved for over two hours.

Figures 4, 5, 6:
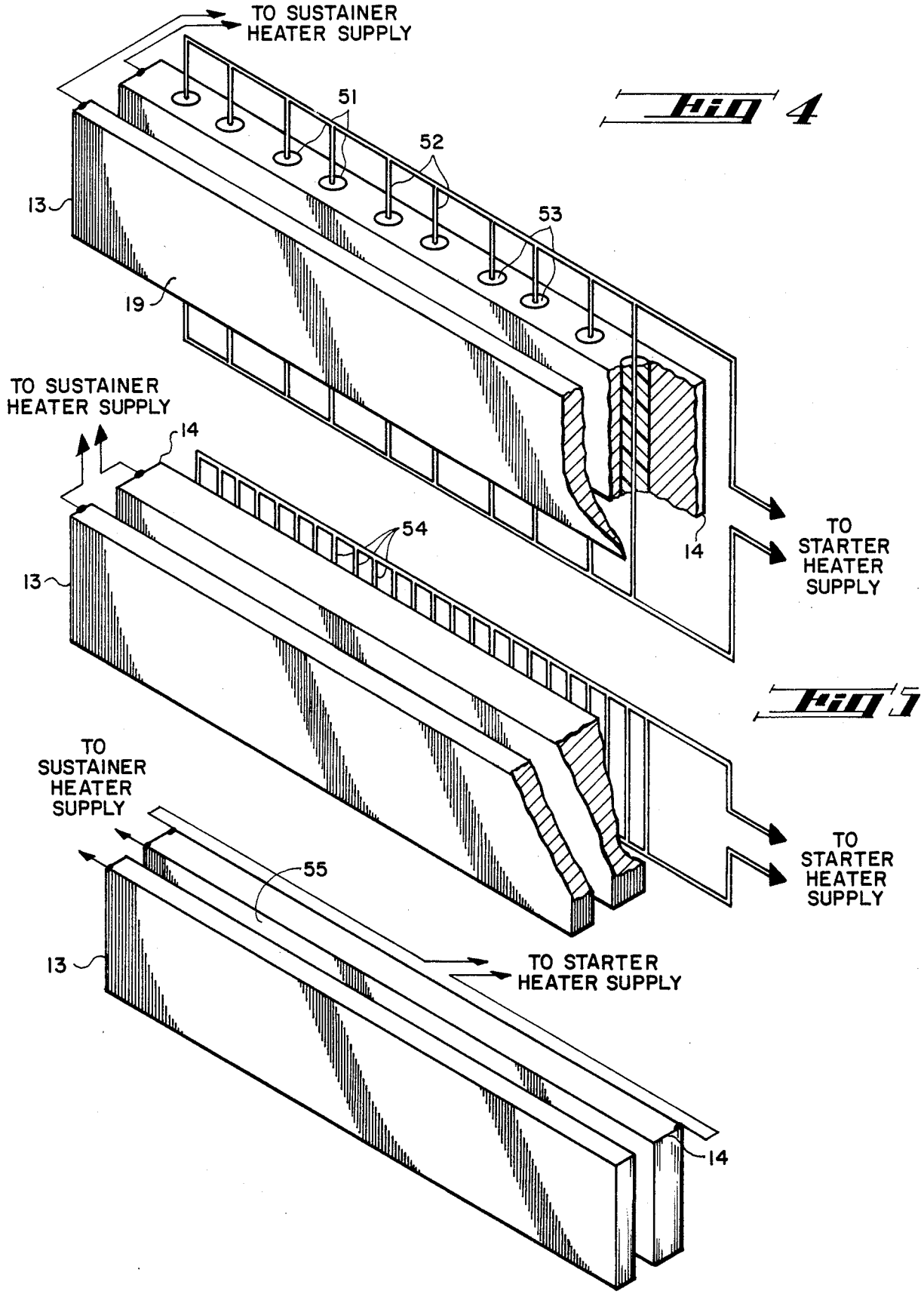
FIG. 4 is a fragmentary perspective view with parts broken away of one embodiment wherein the heating body is provided with passages containing electrical heating means for initially heating the heating body.
FIG. 5 is a fragmentary side view with parts broken away of another embodiment wherein heating means for initially heating the heating body are disposed behind the heating body.
FIG. 6 is a perspective view of a planar cathode and heating body wherein the heating body is initially heated by the passage of current through it.

FIG. 4 illustrates a cathode-heating body arrangement wherein resistance heating is utilized to heat the heating body 14. For this purpose, a plurality of uniformly spaced holes 51 are drilled in the heating body 14 and a tungsten heating rod 52 imbedded in an alumina ceramic insulating jacket 53 is disposed in each hole 51. The heating rods 52 are then connected in parallel and coupled to the low voltage heater supply. Thus, the heating rods 51 uniformly raise the temperature of the heating body 14 to incandescence and radiationally heats the cathode 13 to just above its activation temperature. This resistive heater power is then turned down as the back electron beam voltage is turned up to take over heating.

FIG. 5 illustrates another cathode-heating body arrangement wherein parallel connected heating filaments 54 are disposed behind or rearwardly of the heating body 14. While this arrangement is less efficient than that of FIG. 1, it leaves the space between the cathode and heating body open.

FIG. 6 illustrates a still further cathode-heating body arrangement wherein the heating body is planar and formed of pyrolytic graphite, wherein the crystallographic c-axis of the pyrolytic graphite extends everywhere normal to the surface of the heating body 14 facing the cathode 13. Such a heating body will provide a substantially homogeneous temperature distribution when connected to the low voltage heater supply.

It is to be noted that the heater power supplies may can be either AC or DC. If, for example, an alternating current (AC) sustainer heater power supply is used, the heater current will be automatically rectified by the diode action of the emissive cathode if the heating body has a lower election emission. Further, the use of an AC power supply has the advantage of being less costly than a DC power supply and permits one to simply and conventionally couple it into the high voltage system by means of transformers.

The various features and advantages of the invention are thought to be clear from the foregoing description. Various other features and advantages not specifically enumerated will undoubtedly occur to those versed in the art, as likewise will many variations and modifications of the preferred embodiment illustrated, all of which may be achieved without departing from the spirit and scope of the invention as defined by the following claims.

We claim:

1. A thermionic cathode comprising:

(a) an electron emissive body having a front and a rear electron emissive surface;

(b) a heating body disposed adjacent said rear electron emissive surface and having a front surface facing said cathode rear surface and adapted to substantially uniformly heat said rear electron emissive surface by radiation;

(c) first means for heating said rear electron emissive surface to an electron emission temperature; and (d) second means for causing current flow comprising electron flow from said rear electron emissive surface to said heating body sufficient to heat said heating body to a temperature effective to raise the temperature of said front emissive surface to at least its emission temperature.

2. The combination as defined in claim 1 wherein said first and second means are each adjustable to provide different levels of heating from zero to a predetermined maximum.

3. The combination as defined in claim 1 wherein said second means comprises means for providing a first voltage between said emissive body and said heating body effective to cause electrons emitted by said rear electron emitting surface to flow to said heating body.

4. The combination as defined in claim 3 wherein said cathode and heating body are spaced apart a first distance that said current flow therebetween is effectively space charge limited to substantially that required to provide a predetermined rate of electron emission from said front emissive surface.

5. The combination as defined in claim 3 wherein said first voltage is variable in magnitude.

6. The combination as defined in claim 4 wherein said cathode rear surface and said heating body front surface at their facing peripheries are spaced apart a distance whereby current flow therebetween is space charge limited to a value that at least in part compensates for thermal edge losses.

7. The combination as defined in claim 1 wherein said second means is an alternating current source.

8. A thermionic cathode comprising:

(a) a planar electron emissive body having a front and a rear electron emissive surface;

(b) a planar heating body disposed adjacent said rear electron emissive surface for substantially uniformly radiatively heating said electron emissive body;

(c) first means for variably heating said heating body to a temperature sufficient to effect heating of said rear electron emissive surface to an electron emission temperature; and (d) second means including means for variably applying a voltage between said emissive body and said heating body effective to cause electrons emitted by said rear electron emitting surface to flow to said heating body to heat said heating body to a temperature effective to raise the temperature of said front emissive surface to a temperature providing a predetermined rate of emission from said front emissive surface.

9. The method of providing a predetermined rate of electron emission from an emissive front surface of a thermionic cathode comprising the steps of:

(a) providing an emissive rear surface on said cathode;

(b) disposing a heating body adjacent said emissive rear surface for radiatively heating said cathode;

(c) heating said emissive rear surface to an electron emission temperature; and (d) applying an adjustable voltage between said cathode and said heating body effective to cause electrons emitted by said emissive rear surface to flow to said heating body to heat said heating body to a temperature effective to raise the temperature of said emissive front surface to provide therefrom said predetermined rate of electron emission.

10. The method as defined in claim 9 and additionally including the step of at least substantially reducing heating of said rear surface to said first electron emission temperature subsequent to effecting said flow of electrons to said heating body.

11. The method as defined in claim 10 wherein as current flows between said cathode and said heating body, heating of said emissive rear surface is reduced.

12. The method as defined in claim 11 wherein said cathode and heating body are spaced apart a distance that electron flow therebetween is effectively space charge limited to substantially that required to provide said predetermined rate of electron emission from said emissive front surface.

13. The method as defined in claim 12 wherein electron flow from the periphery of said cathode rear surface to said heating body is adjusted to at least in part compensate for thermal edge losses.

14. The method as defined in claim 13 wherein said adjustable voltage is an alternating voltage.

* * * * *